US012635778B1

(12) United States Patent
Zhou

(10) Patent No.: US 12,635,778 B1
(45) Date of Patent: May 26, 2026

(54) MODULAR ELECTRIC NAIL CLIPPER

(71) Applicant: Shenzhen Gekai Technology Co., Ltd., Shenzhen (CN)

(72) Inventor: Liangli Zhou, Shenzhen (CN)

( * ) Notice: Subject to any disclaimer, the term of this patent is extended or adjusted under 35 U.S.C. 154(b) by 0 days.

(21) Appl. No.: 19/439,357

(22) Filed: Jan. 3, 2026

(30) Foreign Application Priority Data

Dec. 12, 2025 (CN) ..... 202522643016.0

(51) Int. Cl.
*A45D 29/05* (2006.01)
*A45D 29/02* (2006.01)
*A45D 29/06* (2006.01)

(52) U.S. Cl.
CPC ..... *A45D 29/05* (2013.01); *A45D 29/023* (2013.01); *A45D 29/06* (2013.01)

(58) Field of Classification Search
CPC ..... A45D 29/00; A45D 29/02; A45D 29/023; A45D 29/05; A45D 29/14; A45D 2029/026; A01K 13/00
See application file for complete search history.

(56) References Cited

FOREIGN PATENT DOCUMENTS

| | | |
|---|---|---|
| CN | 105231635 A | 1/2016 |
| CN | 220545945 U | 3/2024 |
| CN | 221105090 U | 6/2024 |

*Primary Examiner* — Rachel R Steitz
*Assistant Examiner* — Karim Asqiriba
(74) *Attorney, Agent, or Firm* — Nitin Kaushik

(57) ABSTRACT

The invention discloses a modular electric nail clipper, which includes a power compartment, a chip storage compartment located above the power compartment, and a working head assembly disposed side by side with the chip storage compartment. The working head assembly is inserted into and engaged with the chip storage compartment and locked by a locking mechanism inside the power compartment. An output shaft of a motor is connected to a tenon of a drive shaft of a cutting tool through a tenon groove by direct insertion. An opening of the working head assembly is of a pointed structure. The invention achieves quick-change and secure locking of the cutter head, reliable transmission to prevent chip jamming, safe and comfortable trimming, and convenient chip collection.

5 Claims, 11 Drawing Sheets

MODULAR ELECTRIC NAIL CLIPPER

CROSS-REFERENCE TO RELATED APPLICATIONS

The application claims priority to Chinese patent application No. 2025226430160, filed on Dec. 12, 2025, the entire contents of which are incorporated herein by reference.

TECHNICAL FIELD

The invention relates to the field of personal care appliances, in particular, to a modular electric nail clipper.

BACKGROUND

Most existing electric nail clippers adopt an integrated design, with their trimming heads usually fixed and limited in function, failing to meet diverse needs of users for filing and trimming nails of different shapes. Meanwhile, their storage compartments are often small in capacity and inconvenient to clean, and nail clips can easily fly or clog the transmission mechanism, affecting their service life. In addition, traditional nail clippers often have a straight opening, which makes it difficult to insert and comfortably trim deeply ingrown or highly curved nails, resulting in limitations in use and safety hazards.

Therefore, it is necessary to design a new electric nail clipper to solve the above problems.

SUMMARY

In view of the above, the purpose of the invention is to overcome the shortcomings of the prior art and provide a modular, easy-to-clean, and adaptable electric nail clipper.

In order to achieve above purpose, the invention employs the following technical solutions.

A modular electric nail clipper, comprising:

a power compartment extending longitudinally, provides inside with a motor and a battery;

a chip storage compartment, located on one side above the power compartment and formed inside with a storage cavity for collecting nail chips;

a working head assembly, located on the other side above the power compartment;

wherein the working head assembly includes a cutter head base, the cutter head base is engaged and positioned with the chip storage compartment, and the power compartment is provided inside with a locking structure to lock the cutter head base;

an output shaft of the motor is connected in a transmission manner to a cutting tool inside the cutter head base.

Further, the cutting tool includes a shearing head and a grinding head.

Further, the cutting tool is rotatably mounted inside the cutter head base, and an end of the drive shaft is provided with a tenon; the output shaft of the motor is provided with a tenon groove matching the tenon, and the tenon and the tenon groove are connected by axial insertion and connection to form a drive connection.

Further, the cutter head base is provided with an opening for a fingernail to be inserted, and a contour of the opening is of a pointed structure.

Further, the locking structure includes an elastic latch disposed inside the power compartment and a locking groove disposed on the cutter head base; when the cutter head base is mounted in place, the elastic latch is engaged with the locking groove to achieve locking.

More further, the cutter head base is matched with the slide groove disposed on the chip storage compartment by a slide rail provided on a side portion thereof, and the cutter head base slides horizontally from the outside to the inside to be inserted into and engaged with a working position. The elastic latch is slidably disposed inside the power compartment with a sliding direction perpendicular to an insertion and engagement direction of the cutter head base. The locking structure further includes an operation button, a lever and a return spring. The operation button is movably disposed on an outer shell of the power compartment; the lever is rotatably disposed inside the power compartment, with a first end matching with an inner side of the operation button and a second end matching with a rear end of the elastic latch; the return spring acts on the elastic latch to provide the elastic latch with an elastic force that extends in a locking direction. When the operation button is pressed, the lever is pushed to rotate, and further the second end of the lever drives the elastic latch to slide backward and retract against the elastic force of the return spring for disengaging from the locking groove to release the locking.

Further, the battery is a lithium polymer battery or a dry cell.

Beneficial Effects

1. Modularity and multi-functionality are achieved. By designing the working head assembly as a replaceable module, users can quickly replace and install the working head assembly as needed. Two core functions of trimming and grinding in one machine are achieved.
2. Compatibility and security of the application are improved. In response to the shortcomings of existing products with flat and straight openings, the invention designs the opening of the working head assembly as being of a pointed structure. The pointed structure allows the nail embedded in the flesh to be pried up and trimmed. The cutter head base on the outside of the cutting tool allows the user to better control the skin on their fingers and toes to maintain a certain distance from the grinding wheel, reducing the chance of the cutting tool, such as the grinding head, abrading the skin.
3. The transmission is reliable, effectively extending the service life. The invention abandons the traditional friction wheel or gear transmission that is prone to jamming, and adopts a direct insertion tenon and mortise drive shaft design. When the working head assembly is mounted in place, the tenon at the end of the drive shaft is directly inserted into the tenon groove of the output shaft of the motor, forming a rigid coaxial drive connection. The closed transmission path completely isolates nail clips from intrusion, avoiding problems such as transmission failure and motor overload caused by clip blockage, ensuring efficient and stable power transmission, and significantly improving the reliability and durability of the product.
4. The product is securely locked and easy to operate. The working head assembly is inserted by guiding the slide rail on the slide groove, and is finally automatically locked by a precision locking mechanism that integrates buttons, levers, and springs. The mechanism utilizes the lever principle, achieving a secure axial lock with minimal pressure through the vertically-moving latch, ensuring the cutter head never loosens during high-speed operation; unlocking and replacement can be achieved with a single press, requiring no tools throughout the process, thus guaranteeing both stability in use and ultimate convenience for users.

5. The product is more scientifically organized and easier to clean. A design of an independent, large-capacity chip storage compartment that is parallel to the work area is adopted. The chips generated during trimming is directed directly into and collected in the dedicated chamber, preventing splashing and keeping the environment clean.
6. The compact design enhances the user experience. The overall layout adopts a parallel arrangement of "power compartment-chip storage compartment-working head", which is compact, comfortable to hold and ergonomic.

Figure 1:
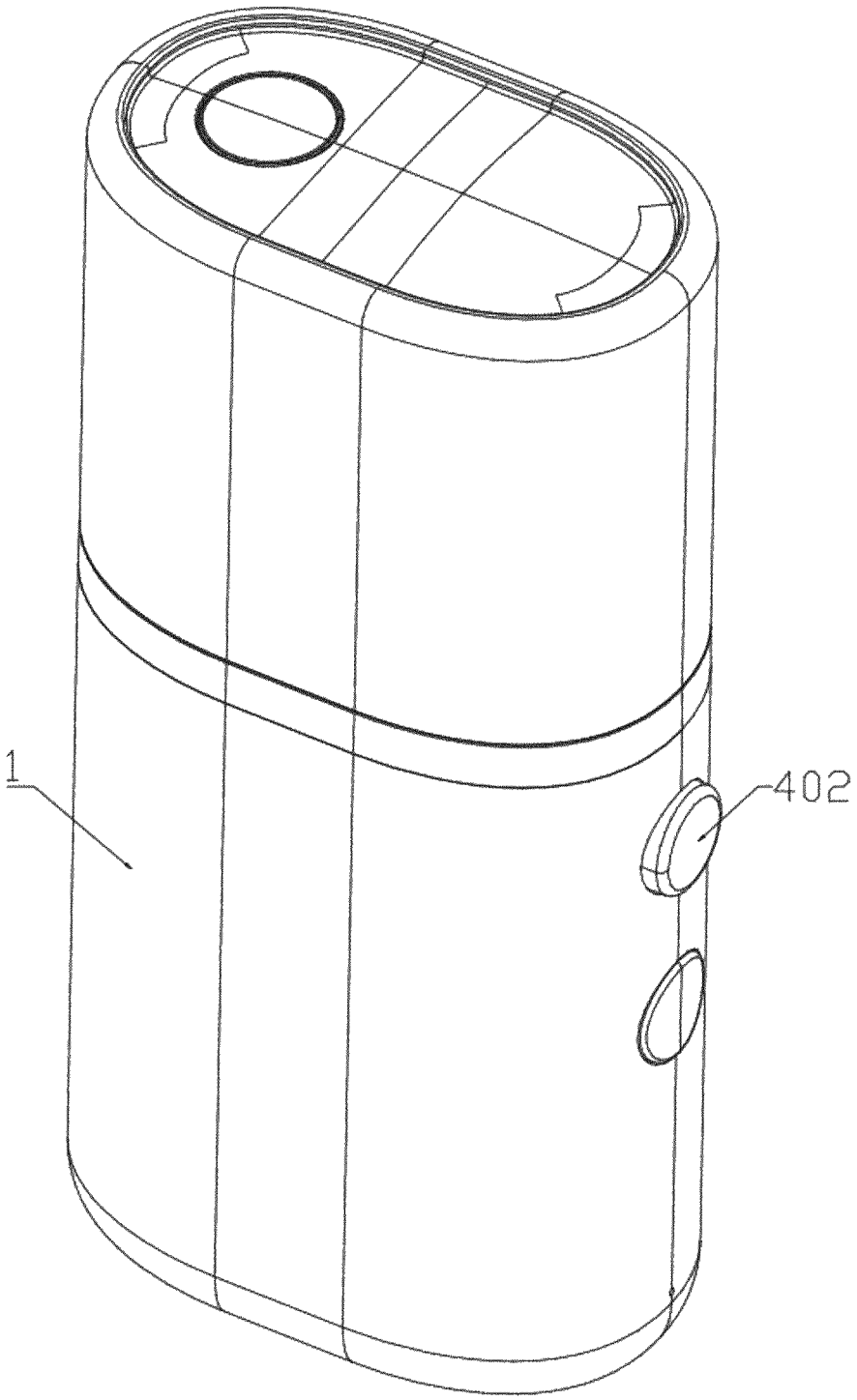
FIG. 1 is a diagram of the overall structure of the application with a cover.

Descriptions of reference numerals: power compartment—1; chip storage compartment—2; compartment cover—201; slide groove—202; working head assembly—3; cutter head base—301; slide rail—301*a*; locking groove—301*b*; cutting tool—302; tenon—303; pointed structure—304; locking structure—4; elastic latch—401; operation button—402; lever—403; return spring—404; motor—5; tenon groove—501; battery cover—6.

DETAILED DESCRIPTION OF THE EMBODIMENTS

Clear and intact description will be made on technical schemes in the embodiments of the invention below in combination with drawings in the embodiments of the invention. Obviously, the described embodiments are merely a part of embodiments of the invention and are not all the embodiments. Based on the embodiments of the present invention, all the other embodiments obtained by those of ordinary skill in the art without inventive effort are within the scope of the present invention.

Figure 2:
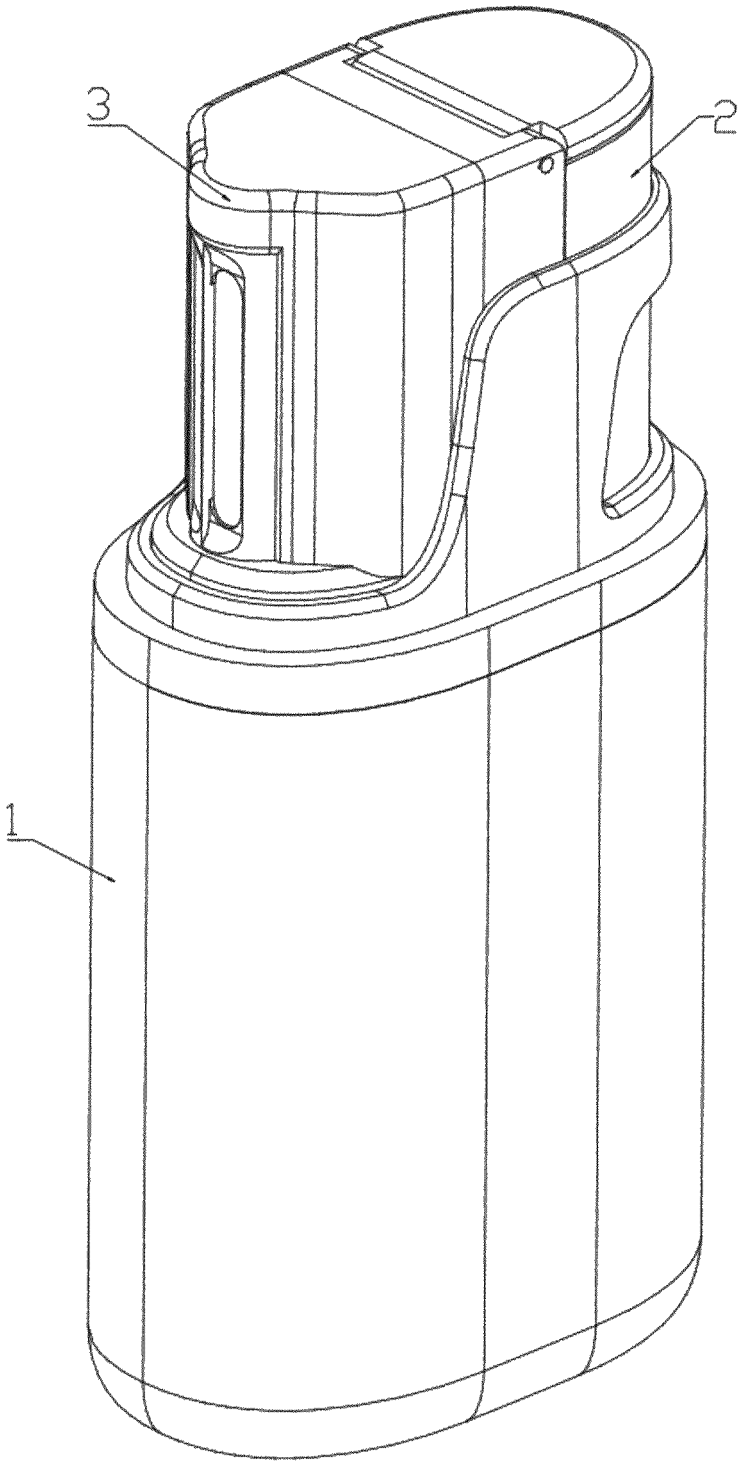
FIG. 2 is a structural diagram of the application without a cover.
Figure 3:
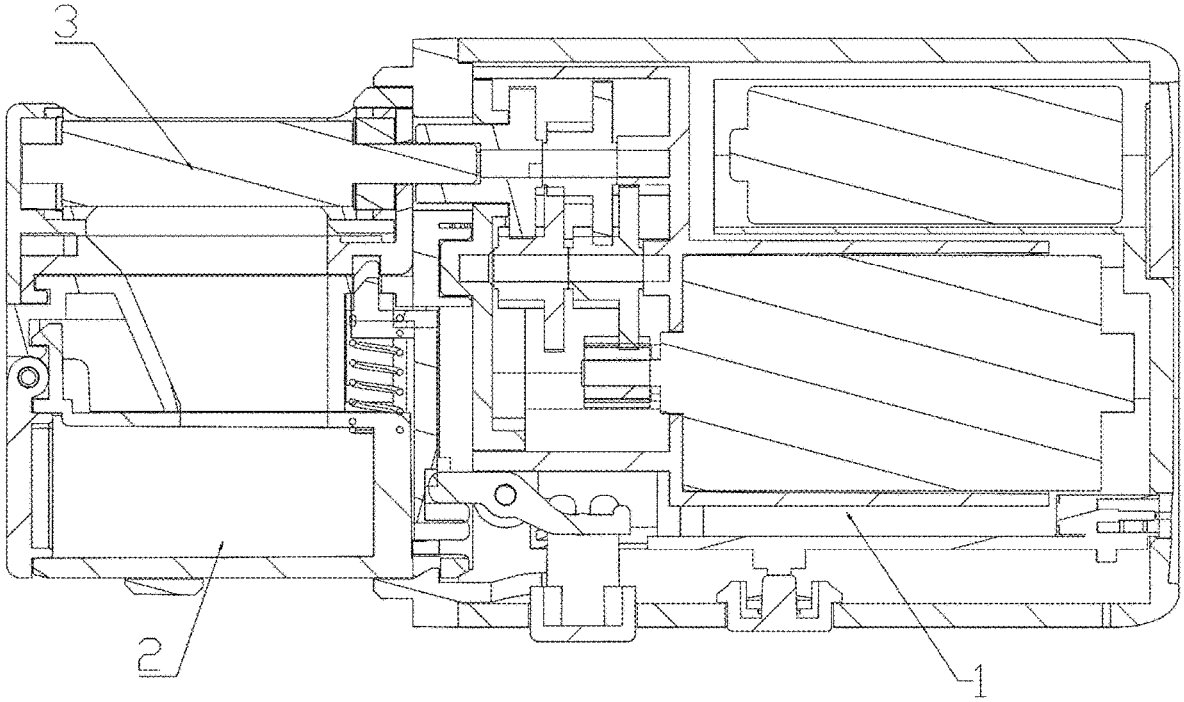
FIG. 3 is a cross-sectional structural diagram of the application in a usage state.
Figure 4:
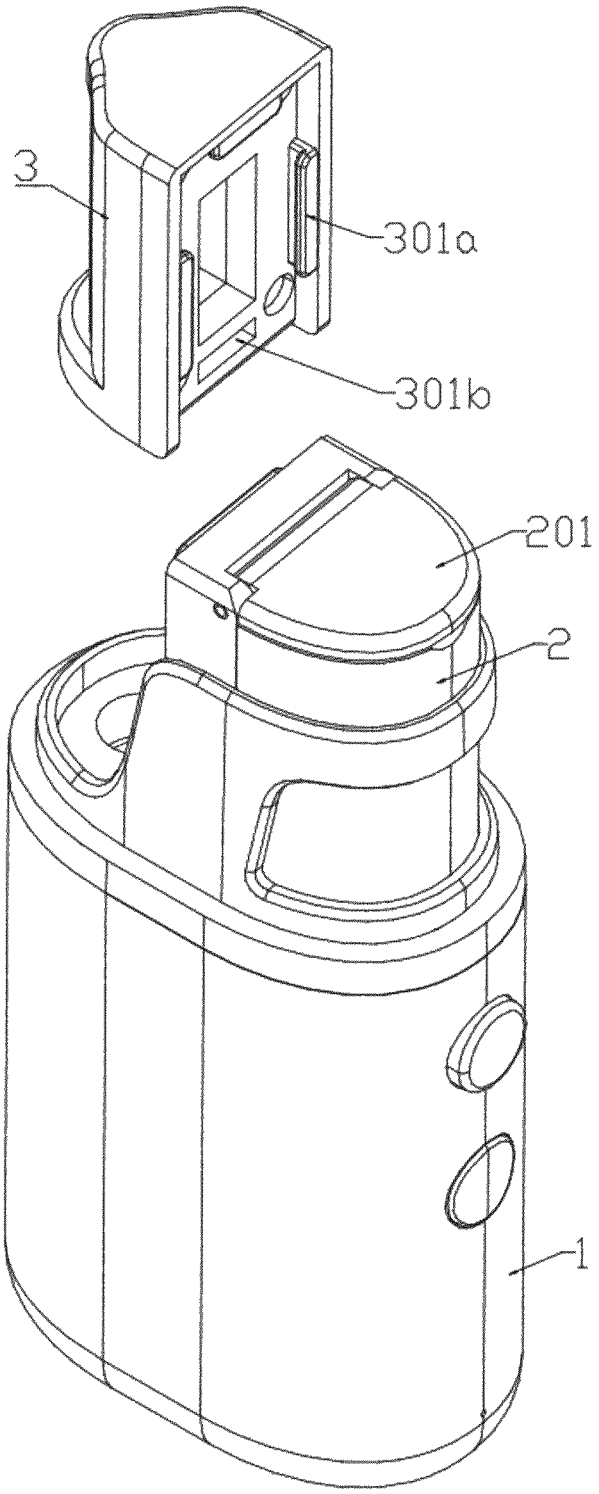
FIGS. 4 and 5 are diagrams of the assembly structure of a working head assembly of the application from different perspectives.
Figure 5:
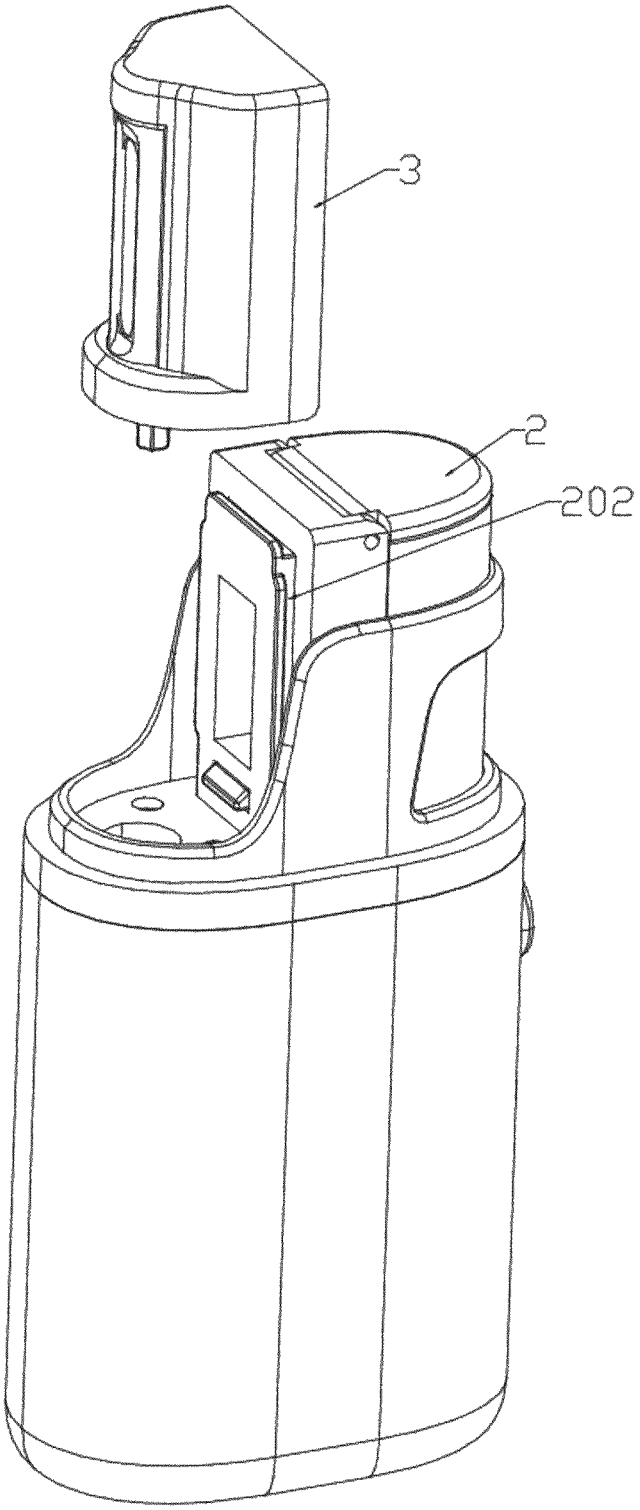
Figure 6:
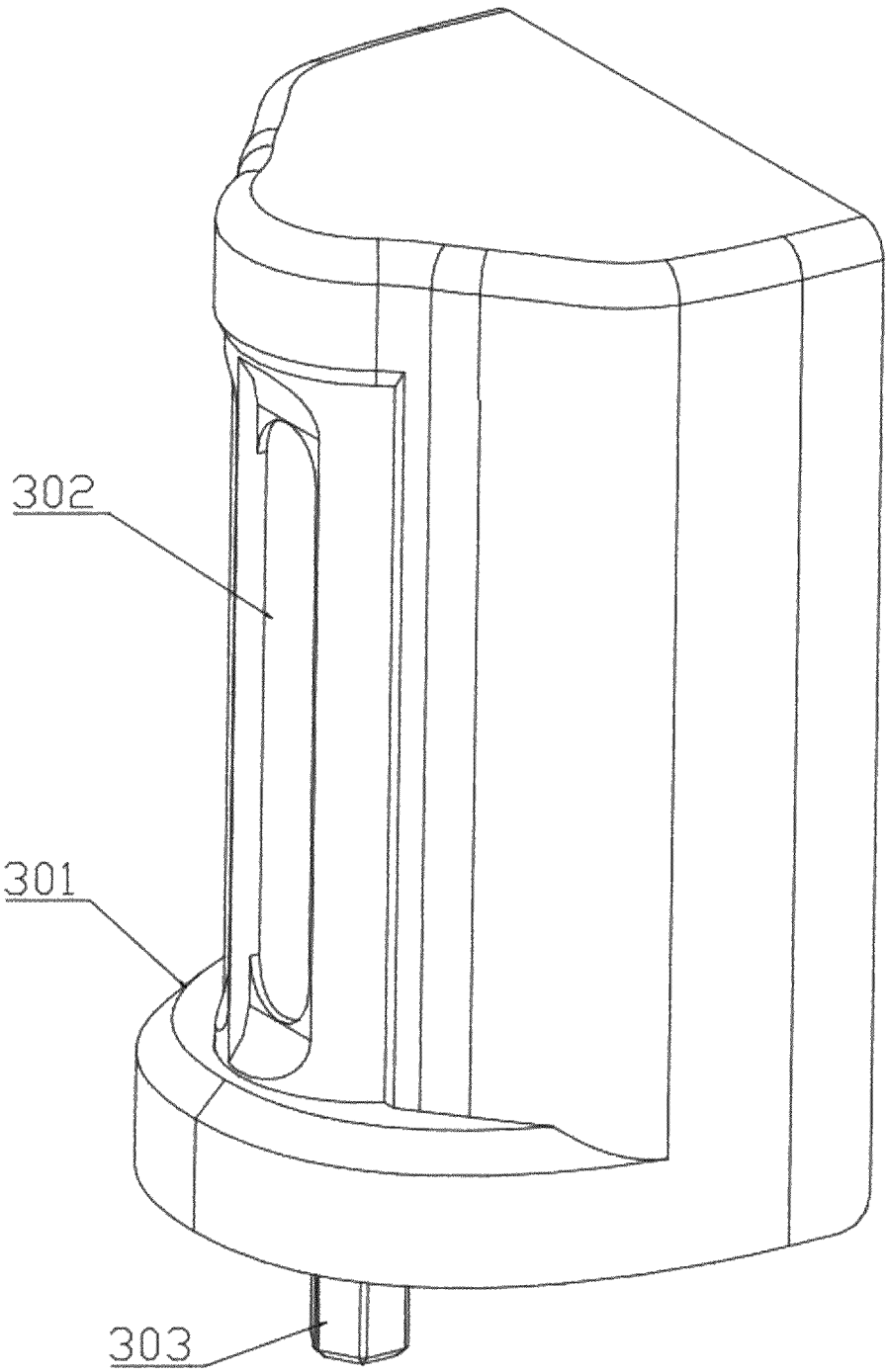
FIG. 6 is a structural diagram of the working head assembly of the application.
Figure 7:
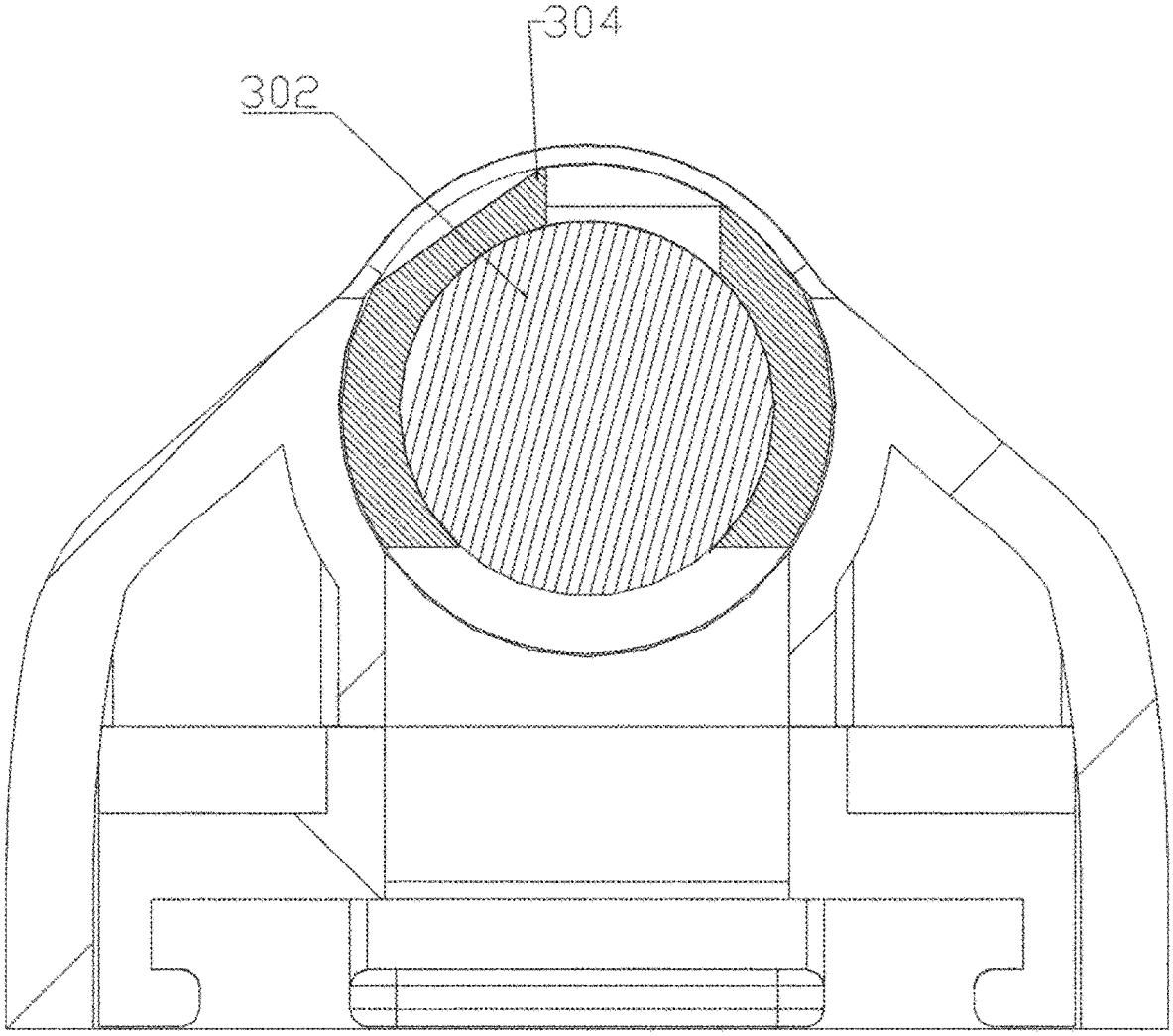
FIG. 7 is a cross-sectional structural diagram of the working head assembly of the application.
Figure 8:
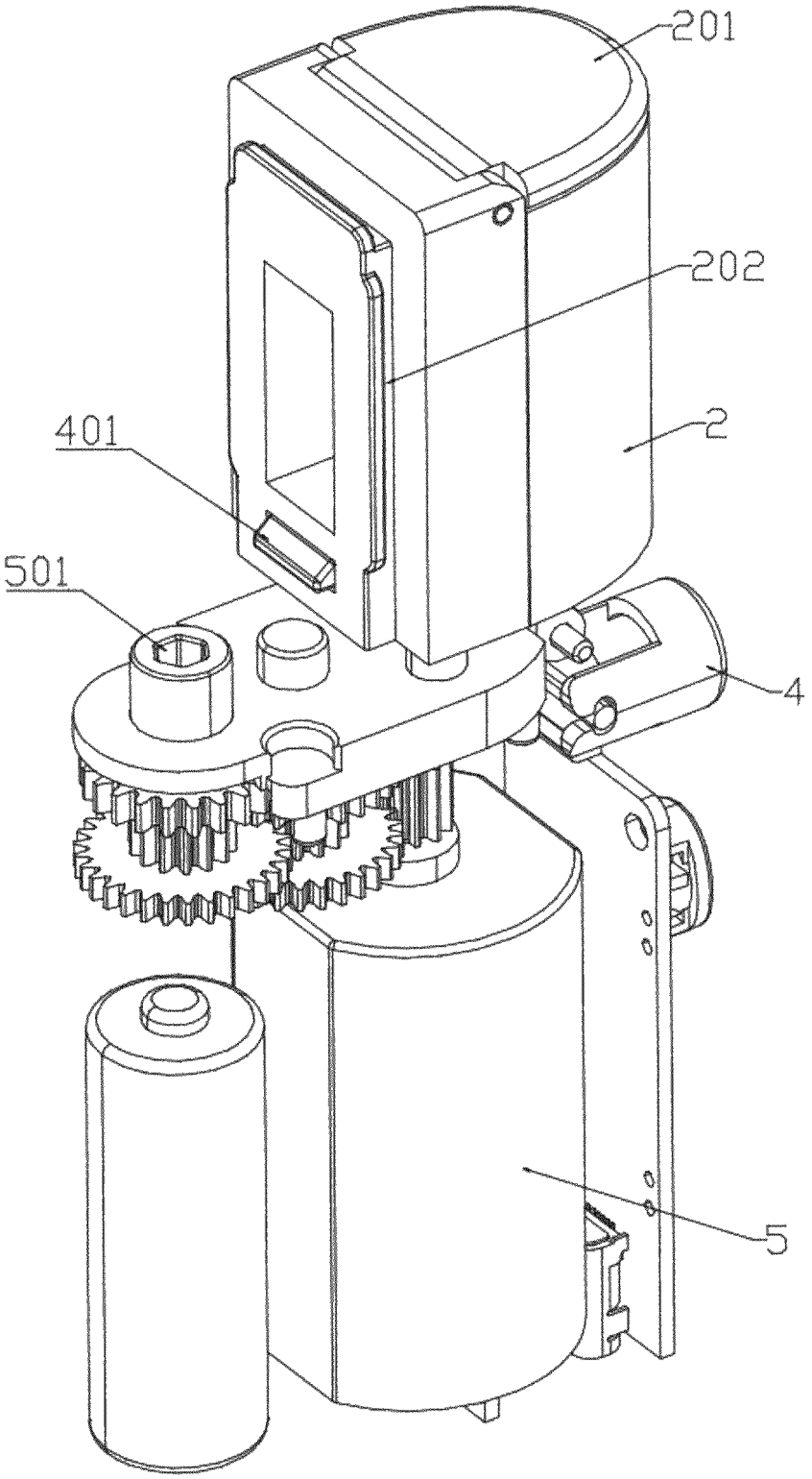
FIG. 8 is a diagram of the internal structure of a power compartment in the application.
Figure 9:
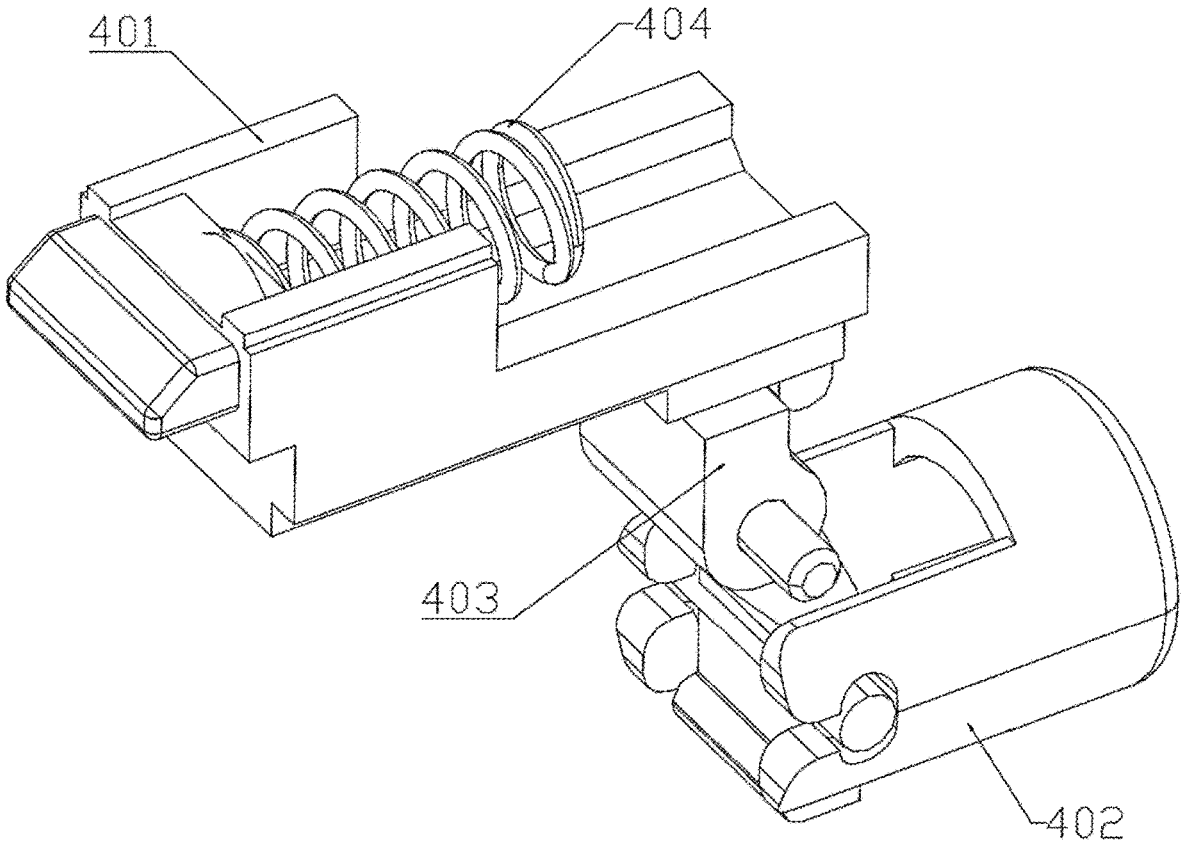
FIG. 9 is a diagram of the locking structure of the application.
Figure 10:
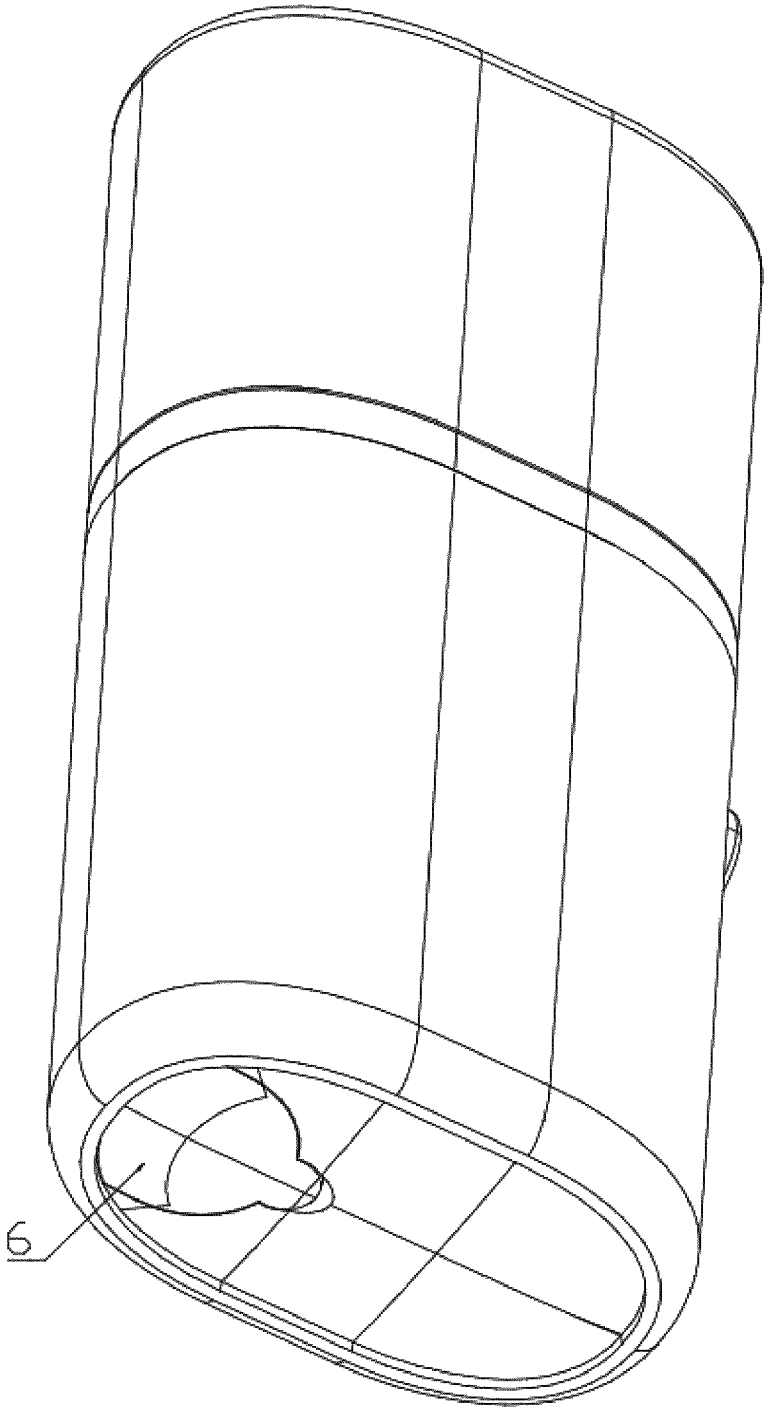
FIG. 10 is a structural diagram of the application using a dry cell matching a battery cover.
Figure 11:
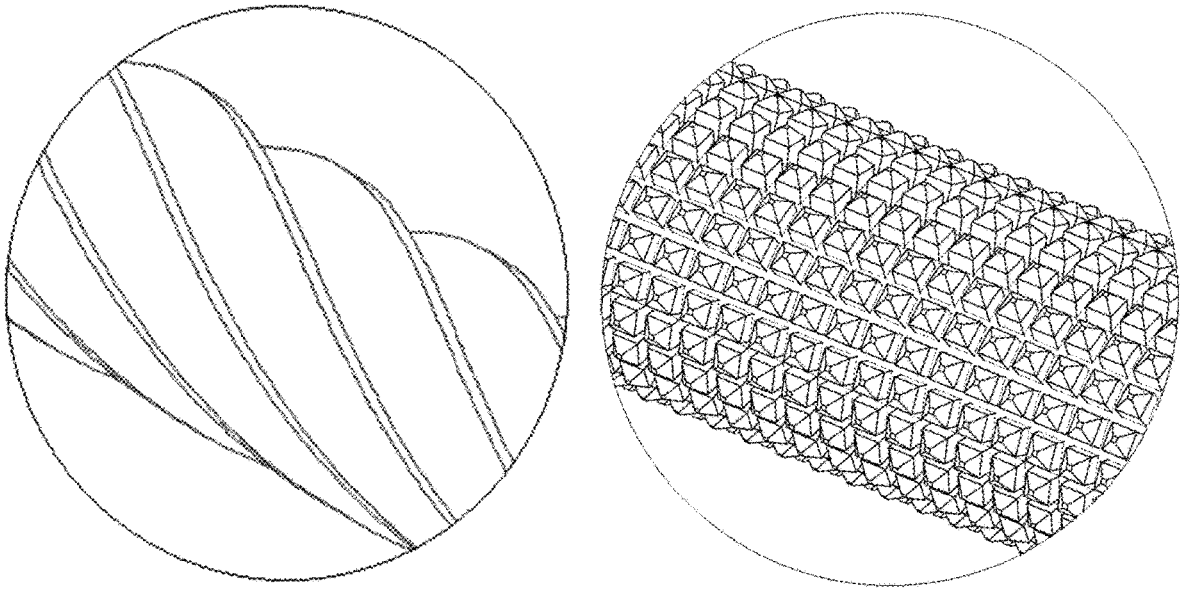
FIG. 11 is a structural diagram of a shearing head (left) and a grinding head (right).

With reference to FIGS. 1 to 11, a modular electric nail clipper includes:

a power compartment 1 forming a handle and a power source, a chip storage compartment 2 for collecting chips, and a working head assembly 3 that performs trimming or grinding functions.

The chip storage compartment 2 and the working head assembly 3 are located side by side above the power compartment 1, each occupying one side, forming a stable and ergonomic structure.

The power compartment 1 is in a long cylindrical shape, forming a main portion held by a user. The power compartment is provided inside with a motor 5, a battery, and a control circuit board.

The battery offers two flexible power supply options: one is a built-in rechargeable lithium polymer battery, which may be charged by a universal charging port such as Micro-USB or Type-C located on the side or bottom of the compartment; the other is a removable and replaceable dry cell, which may be replaced by a battery cover 6 located on the side or bottom of the compartment.

The chip storage compartment 2 is fixedly connected to one side of a top of the power compartment 1. A cavity with an open top is designed inside as a dedicated storage chamber for collecting and storing all nail clips generated during the trimming process. To facilitate the disposal of nail clips, the clip storage compartment 2 is equipped with an openable and closable cover 201, and the openable and closable cover 201 may be opened by rotating or sliding. Preferably, a shell of the chip storage compartment 2 is made of transparent or semi-transparent material, allowing the user to visually observe the volume of nail chips inside and making it easy to clean in a timely manner.

The working head assembly 3 is mounted on the other side of the top of the power compartment 1, adjacent to the chip storage compartment 2 side by side. The working head assembly is provided with a cutter head base 301. The cutter head base 301 is not directly fixed to the power chamber 1, but is mounted through a sliding, inserting and locking mechanism. Specifically, a slide rail 301*a* is disposed on a side surface of the cutter head base 301, and a corresponding slide groove 202 is disposed on a side wall of the adjacent chip storage compartment 2. During installation, the user pushes the cutter head base 301 horizontally inward from the outside of the device, and the slide rail 301*a* moves along the slide groove 202 until reaching a preset fully-inserted position. To ensure that the working head assembly 3 remains stable and does not loosen during high-speed operation, a reliable locking structure 4 is designed inside the power compartment 1. The structure mainly includes a flexible latch 401 that may slide horizontally, an operation button 402 exposed from the shell of the power compartment 1, a lever 403 that plays a transmission role, and a return spring 404. A locking groove 301*b* is preset at a bottom of the cutter head base 301. When the cutter head base 301 is pushed to an innermost working position, the elastic latch 401 pops out horizontally under the push of the return spring 404 with a front end just fitting into the locking groove 301*b* of the cutter head base 301, thereby firmly locking the cutter head base 301 and preventing the same from coming out during use. When a cutter head needs to be replaced, the user only needs to press the operation button 402, an inner end of the button pushes the lever 403 to rotate around a fulcrum, the other end of the lever 403 then pulls the elastic latch 401 to cause the latch to compress the return spring 404 to retract backward for thereby exiting from the locking groove 301*b*, and then the cutter head base 301 is then unlocked and may be easily pulled out.

The core function of the working head assembly 3 is in a cutting tool 302. The invention supports modular replacement of the working head assembly 3. Users may select the working head assembly 3 as needed. Different working head assemblies 3 correspond to different cutting tools 302. The cutting tool 302 may have a shearing head or a grinding head. The cutting tool 302 has a drive shaft that extends longitudinally downwards and passes through the cutter head base 301. An end of the drive shaft is designed as a non-circular tenon 303, while an end of the output shaft of the motor 5 is machined with a tenon groove 501 that perfectly matches the shape. When the working head assembly 3 is mounted in place, the tenon 303 at a lower end of the drive shaft will be precisely inserted into the tenon 501 of the shaft of the motor 5, forming a direct, efficient, and coaxial drive connection. The direct-drive transmission method avoids the chip jamming problem that may occur when using gears or friction wheels, making the transmission more reliable. The cutter head base 301 on the outside of the cutting tool 302 allows the user to better control the skin on their fingers and toes to maintain a certain distance from the grinding wheel, reducing the chance of the cutting tool, such as the grinding head, abrading the skin. The cutter head base 301 may be made of plastic.

A key improvement of the invention is the opening in the working head assembly 3. Unlike traditional straight openings, a contour of the opening is specially designed as being of a pointed structure 304. The study of the pointed structure 304 is consistent with human nails, especially common ingrown nails or nails with large curvature. The pointed structure 304 allows the nail embedded in the flesh to be pried up and trimmed.

The usage process is briefly described as follows: The user installs the corresponding working head assembly 3 onto the power compartment 1 according to the requirements. A power switch is turned on, and the motor 5 will be initiated. During trimming or grinding operations, the generated chips is guided to the chip storage compartment 2 below for centralized storage. After use, the power is turned off and the cover 201 of the clip storage compartment 2 is opened to easily pour the clips into the trash can and keep the product clean.

Although the embodiments of the present invention have been shown and described, it can be understood that a person skilled in the art can make various changes, modifications, substitutions and variations to the embodiments without departing from the principle and spirit of the present invention; and the scope of the present invention is defined by the attached claims and equivalents thereof.

What is claimed is:

1. A modular electric nail clipper, comprising:

a power compartment (1) extending longitudinally, provides inside with a motor (5) and a battery;

a nail chips storage compartment (2), located on one side above the power compartment (1) and formed inside with a storage cavity for collecting the nail chips;

a working head assembly (3), located on another side above the power compartment (1);

wherein the working head assembly (3) comprises a cutter head base (301), the cutter head base (301) is engaged and positioned with the nail chips storage compartment (2), and the power compartment (1) is provided inside with a locking structure (4) to lock the cutter head base (301);

an output shaft of the motor (5) is connected in a transmission manner to a cutting tool (302) inside the cutter head base (301);

wherein the cutting tool (302) is rotatably mounted inside the cutter head base (301), and the cutting tool (302) is provided with a drive shaft; an end of the drive shaft is provided with a tenon (303), the output shaft of the motor (5) is provided with a tenon groove (501) matching the tenon, and the tenon and the tenon groove are connected by axial insertion and connection to form a drive connection;

wherein the cutter head base (301) is matched with a slide groove (202) disposed on the nail chips storage compartment (2) by a slide rail (301*a*) provided on a side portion thereof, and the cutter head base (301) slides from an outside to the inside to be inserted into and engaged to a working position; the elastic latch (401) is slidably disposed inside the power compartment (1) with a sliding direction perpendicular to an insertion and engagement direction of the cutter head base (301); the locking structure (4) further comprises an operation button (402), a lever (403) and a return spring (404); the operation button (402) is movably disposed on the power compartment (1); the lever (403) is rotatably disposed inside the power compartment (1), with a first end matching with an inner side of the operation button (402) and a second end matching with a rear end of the elastic latch (401); the return spring (404) acts on the elastic latch (401) to provide the elastic latch with an elastic force that extends in a locking direction; when the operation button (402) is pressed, the lever (403) is pushed to rotate, and further the second end of the lever (403) drives the elastic latch (401) to slide backward and retract against the elastic force of the return spring (404) for disengaging from the locking groove (301*b*) to release the locking.

2. The modular electric nail clipper according to claim 1, wherein the cutting tool (302) compriss a shearing head and a grinding head.

3. The modular electric nail clipper according to claim 1, wherein the cutter head base (301) is provided with an opening for a fingernail to be inserted, and a contour of the opening is of a pointed structure (304).

4. The modular electric nail clipper according to claim 1, wherein the locking structure (4) comprises an elastic latch (401) disposed inside the power compartment (1) and a locking groove (301*b*) disposed on the cutter head base (301); when the cutter head base (301) is mounted in place, the elastic latch (401) is engaged with the locking groove (301*b*) to achieve locking.

5. The modular electric nail clipper according to claim 1, wherein the battery is a rechargeable lithium polymer battery or a dry cell.

* * * * *